United States Patent [19]

Bushby

[11] Patent Number: 4,501,376

[45] Date of Patent: Feb. 26, 1985

[54] CONTAINER AND CLOSURE HAVING LUG FASTENING MEANS

[75] Inventor: Maxwell J. Bushby, Marrickville, Australia

[73] Assignee: Commonwealth Moulding Pty. Limited, New South Wales, Australia

[21] Appl. No.: 554,243

[22] Filed: Nov. 22, 1983

[30] Foreign Application Priority Data

Dec. 15, 1982 [AU] Australia ..... PF7277

[51] Int. Cl.[3] ..... B65D 41/06; B65D 41/36

[52] U.S. Cl. ..... 220/298; 220/295; 220/300; 220/301; 220/293

[58] Field of Search ..... 220/293, 294, 295, 298, 220/297, 300, 301, 302

[56] References Cited

U.S. PATENT DOCUMENTS 4,027,777 6/1977 Blanke, Jr. ..... 220/298

4,212,408 7/1980 Valenzona ..... 220/293

*Primary Examiner*—George T. Hall

*Attorney, Agent, or Firm*—Stevens, Davis, Miller & Mosher

[57] ABSTRACT

A pail consists of an open-top body and a lid applicable to the open-top to close it and be reliably secured thereon. The open-top is defined by an annular seating, and a circumferential array of cantilever locking lugs on the body adjacent but spaced from the seating, project radially beyond the seating. The lid has a depending skirt which encircles the seating, when applied, and extends downwardly below said lugs. A series of circumferentially extending locking apertures, equal in number and spacing to the lugs, are formed in the skirt, each having one enlarged end to freely admit one of the lugs and its other end formed as a stricture to take hold of an admitted lug upon fractional rotation of the lid following application to the open-top. A resilient sealing ring is housed in a groove in the lid so that when the lid is applied to the open-top, the ring is compressed between the lid and the body seating.

5 Claims, 7 Drawing Figures

CONTAINER AND CLOSURE HAVING LUG FASTENING MEANS

Pails and like lidded containers are used for the carriage of many different commodities, and some of these are noxious or otherwise dangerous or objectionable. Where this is so, it is officially required, in many places, that the pails survive certain tests. In one such test, for example, the loaded pail is dropped from a prescribed height on to an unyielding floor, and in doing this the lid must remain securely applied to the pail body, both lid and body must remain undamaged and there must be no spillage of the pail contents.

Our consideration of the problem makes it appear that pail failure under test is due largely to such things as lid rim crumpling, cracking or breaking; inadequate mechanical restraint on the sealing gasket (by which the lid is sealed on the body rim) to keep it in required sealing position throughout its circumference; insufficient direct compressive loading on the gasket; and, inadequacy of retentive strength in the means whereby the lid is held to the body.

Thus, the object of this invention is to remedy the shortcomings indicated above, by the provision of a pail which is not prone to cracking, breaking or like failure on test, in which the sealing gasket is adequately constrained and loaded compressively and in which both the pail body and its lid are made wholly as plastics mouldings.

Pails of the kind in question are usually provided with a semi-circular or inverted U-shape, carrying bail. This may be moulded in plastics or formed from metal rod.

In summary, the invention provides a pail of the kind consisting of an open-top body and a lid applicable to the open-top; comprising:

(a) an annular seating which defines said open-top;

(b) a circumferential array of evenly-spaced cantilever clamping lugs on said body, disposed adjacent but below said seating and extending radially from said body to a greater extent that does said seating;

(c) a socket groove formed in the underside of said lid so to open directly above said seating when the lid is applied to the body;

(d) a skirt which depends from the periphery of said lid thereby to encircle and extend below said seating and below said lugs when the lid is applied to the body;

(e) a bottom portion of said skirt of greater diameter than the remainder of said skirt;

(f) locking apertures formed in said skirt to extend circumferentially thereof in correspondence with the number and spacing of said lugs, each having one end partly formed in said bottom portion thereby freely to admit one of said lugs into said aperture, and its other end formed as a restriction able to take hold of a lug admitted into said aperture; and (g) a resilient sealing ring housed in said groove and brought to bear against said seating when said lugs are held within said apertures.

An example of the invention is illustrated in the drawings herewith.

Figure 4:
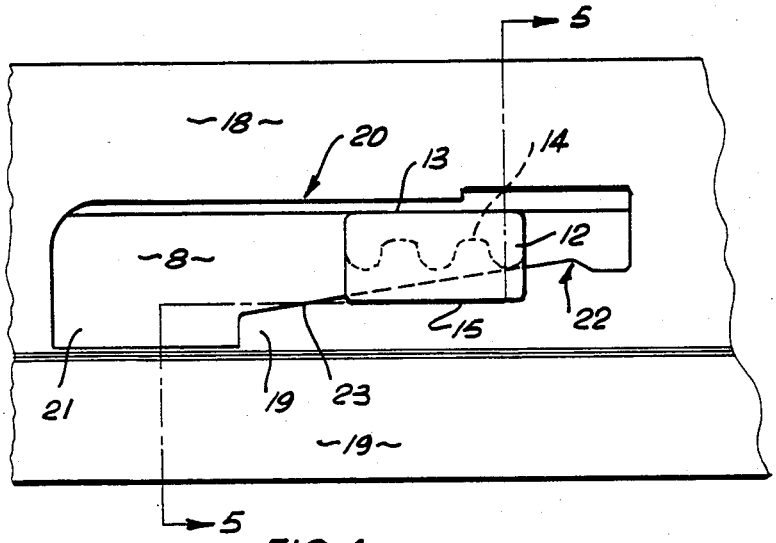
FIG. 4 is a detail of one body-lug partly advanced along a lid aperture.
Figure 6:
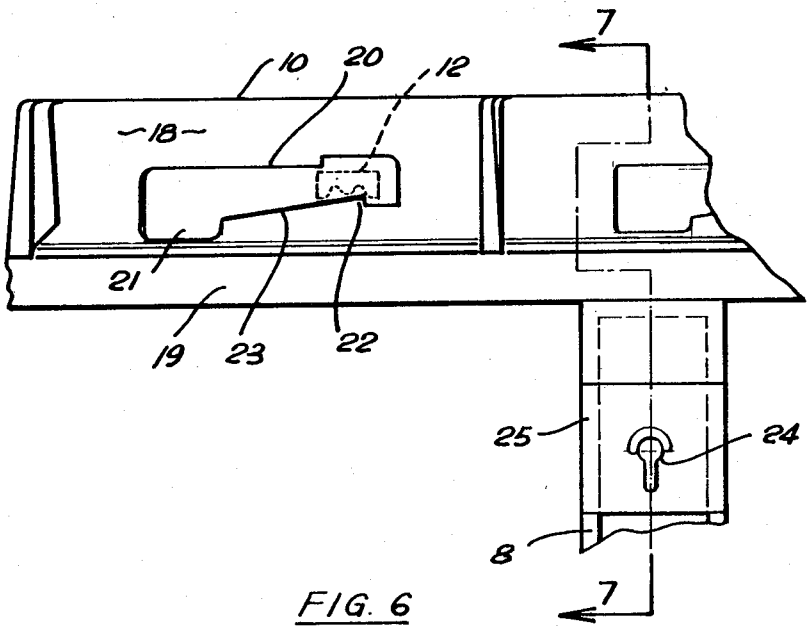

FIG. 6 substantially repeats FIG. 4, but with added details.

Figure 7:
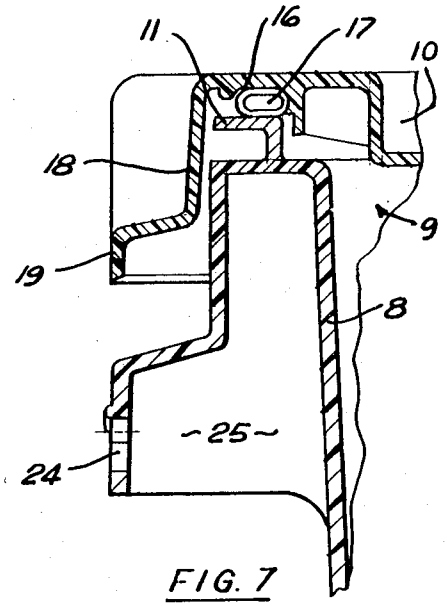

FIG. 7 is a section taken on line 7—7 in FIG. 6.

Referring to the drawings, body 8 has open-top 9 able to receive lid 10.

The open-top 9 is defined by an annular seating 11. Disposed just below seating 11 is a circumferential array of evenly-spaced cantilever lugs 12. These lugs extend radially from the body beyond seating 11. For preference, each of the lugs consists of a shank 13 having underside undulations 14 and a depending flange or head 15.

Figure 1:
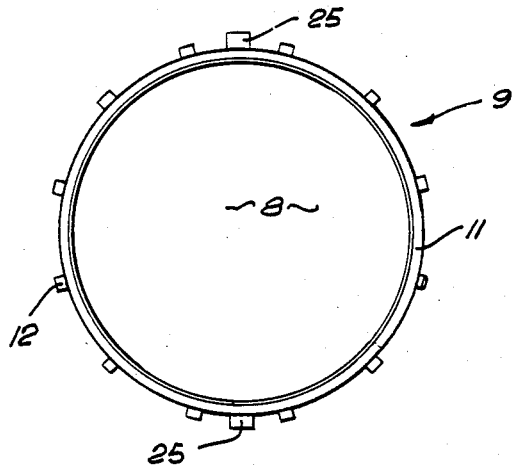
FIG. 1 is a plan of an open-top pail body.
Figure 2:
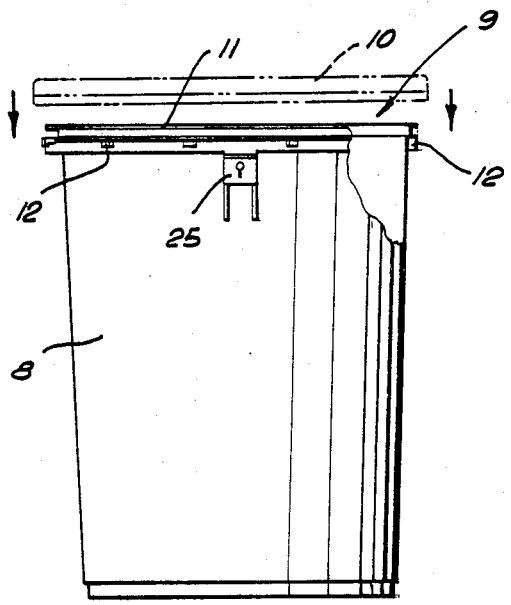
FIG. 2 is a side elevation of the same body with a lid (indicated in dotted lines) about to be applied.
Figure 3:
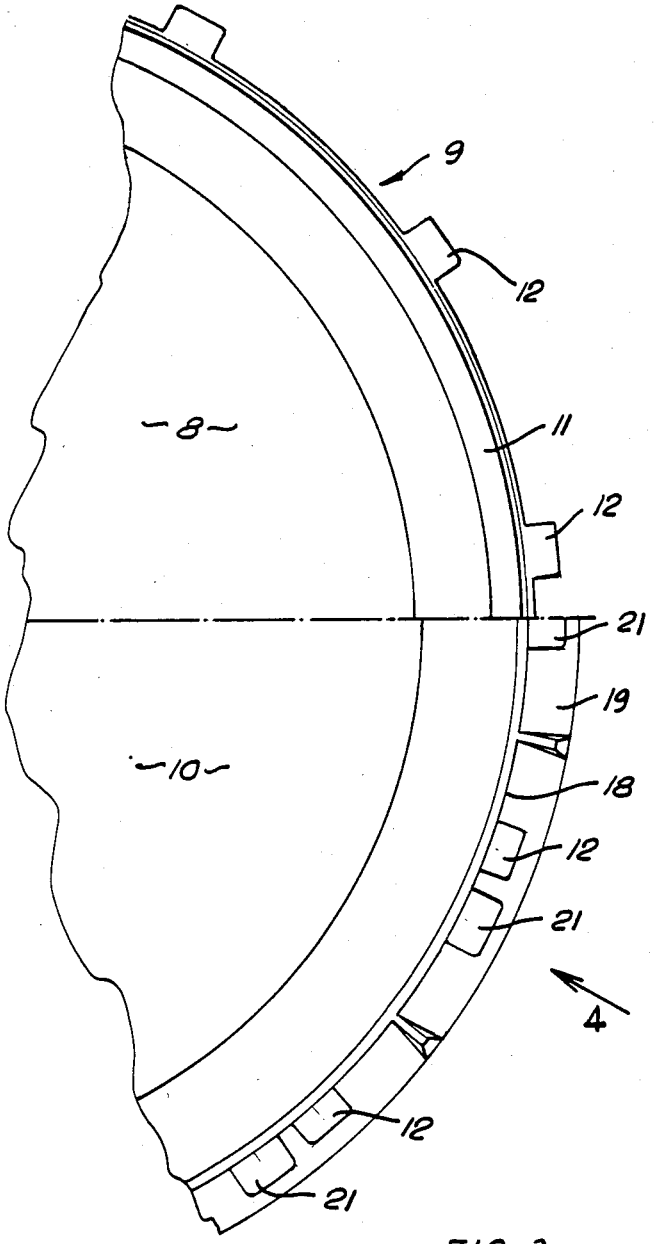
FIG. 3 is a fragmentary plan on an enlarged scale in which the top half shows the body and the lower half a lid applied to the body.
Figure 5:
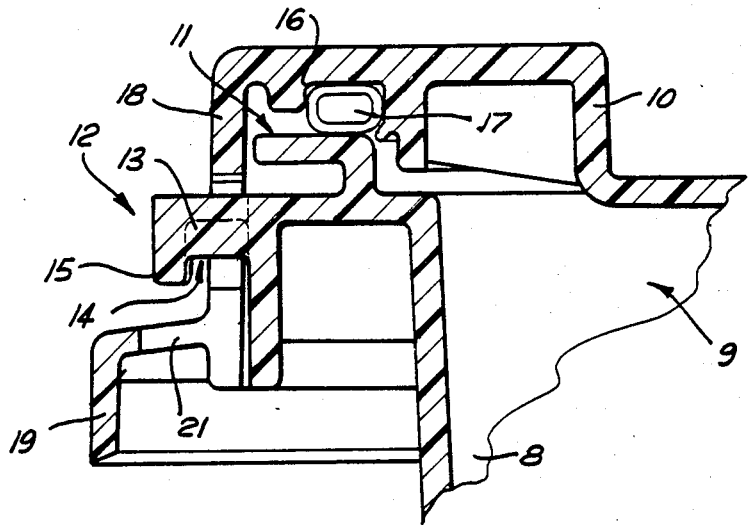
FIG. 5 is a section taken on line 5—5 in FIG. 4.

A socket groove 16 (See FIG. 5) is formed on the underside of lid 10 to house a resilient sealing ring or gasket as indicated at 17.

A skirt 18 depends from the periphery of lid 10 and has a bottom portion 19 whereof the diameter is greater than it is in the remainder of the skirt.

Skirt 18 has locking apertures 20 formed therein to correspond with the number and spacing of lugs 12. Each of these apertures has one end 21 extending into bottom portion 19 so as to permit one of the lugs 12 to be freely entered into the aperture concerned merely by descending the lid on to the open-top of the body with the lid suitably oriented relative to the body.

The other end of each of the apertures 20 is formed as a restriction 22 over which, when the lid is part rotated, the entered lug 12 is able to ride with some frictional resistance as a snap fit relative thereto. The aperture end 21 preferably proceeds towards restriction 22 by way of a ramp 23.

If the pail is one furnished with a conventional carrying bail it may be applied by insertion of its in-turned ends into keyhold slots 24 in a pair of humps 25 moulded on body 6. (See FIGS. 6 and 7).

I claim:

1. A pail of the kind consisting of an open-top body and a lid applicable to the open-top; comprising:

(a) an annular seating which defines said open-top;

(b) a circumferential array of evenly-spaced cantilever clamping lugs on said body, disposed adjacent but below said seating and extending radially from said body to a greater extent that does said seating;

(c) a socket groove formed in the underside of said lid so to open directly above said seating when the lid is applied to the body;

(d) a skirt which depends from the periphery of said lid thereby to encircle and extend below said seating and below said lugs when the lid is applied to the body;

(e) a bottom portion of said skirt of greater diameter than the remainder of said skirt;

(f) locking apertures formed in said skirt to extend circumferentially thereof in correspondence with the number and spacing of said lugs, each having one end partly formed in said bottom portion thereby freely to admit one of said lugs into said aperture, and its other end formed as a restriction able to take hold of a lug admitted into said aperture; and (g) a resilient sealing ring housed in said groove and brought to bear against said seating when said lugs are held within said apertures.

2. A pail according to claim 1 wherein the ends of each of said locking apertures are adjoined by a ramp.

3. A pail according to claim 2 wherein each of said lugs is formed with undulations able to ride the ramp and engage the restriction of a locking aperture into which the lug has been admitted.

4. A pail according to claim 1 in which said body and said lid are plastics mouldings.

5. A pail according to claim 1 wherein said body is furnished with humps having slots therein to accommodate the ends of a carrying bail.

* * * * *